United States Patent [19]

Phillips et al.

[11] Patent Number: 5,054,764

[45] Date of Patent: Oct. 8, 1991

[54] EDGE ALIGNER/HOLDER DEVICE

[75] Inventors: Gregory Phillips; Douglas Langton, both of Seattle, Wash.

[73] Assignee: EMF Corporation, Redmond, Wash.

[21] Appl. No.: 421,081

[22] Filed: Oct. 12, 1989

[51] Int. Cl.[5] ..... B65H 31/38

[52] U.S. Cl. ..... 271/189; 271/221

[58] Field of Search ..... 271/221, 222, 189

[56] References Cited

U.S. PATENT DOCUMENTS

| | | | |
|---|---|---|---|
| 2,950,108 | 8/1960 | Golding . | |
| 3,370,848 | 2/1968 | Bartlett . | |
| 3,933,352 | 1/1976 | Sinn . | |
| 4,318,541 | 3/1982 | Nagel | 271/222 |
| 4,469,321 | 9/1984 | Geschwindner . | |

FOREIGN PATENT DOCUMENTS

| | | | |
|---|---|---|---|
| 726168 | 3/1955 | United Kingdom | 271/221 |

*Primary Examiner*—Richard A. Schacher

*Attorney, Agent, or Firm*—David L. Garrison; Patrick M. Dwyer

[57] ABSTRACT

An edge aligner/holder 10 having an edge aligner 30 with a resilient front end 32 and a tail piece 34 cooperatively interengaged with a reciprocating mechanism 36, and having a holder 20 with at least one rest 23 and one backstop 24, the holder 20 mounted above said front end 32 on said edge aligner 30. The resilient front end 32 of the edge aligner 30 holds a job stack 2 containing sheets which already have been piled in alignment when the edge aligner 30 is in its forward position, while at the same time holding the trailing edge of a next sheet 3, the leading edge of which sheet has already been deposited upon the job stack 2, so that the offset movement of this next sheet 3 may be accomplished without disturbing the alignment and piling of the job stack 2 immediately below it. The edge aligner/holder 10 is then reciprocated to a rearward position to drop the trailing edge of the sheet 3 to allow the sheet 3 to join the job stack 2 while at the same time withdrawing the edge aligner 30 from contact with the job stack 2. The operational cycle is then repeated for each additional next sheet 3 fed onto the job stack 2.

15 Claims, 4 Drawing Sheets

FIG.2
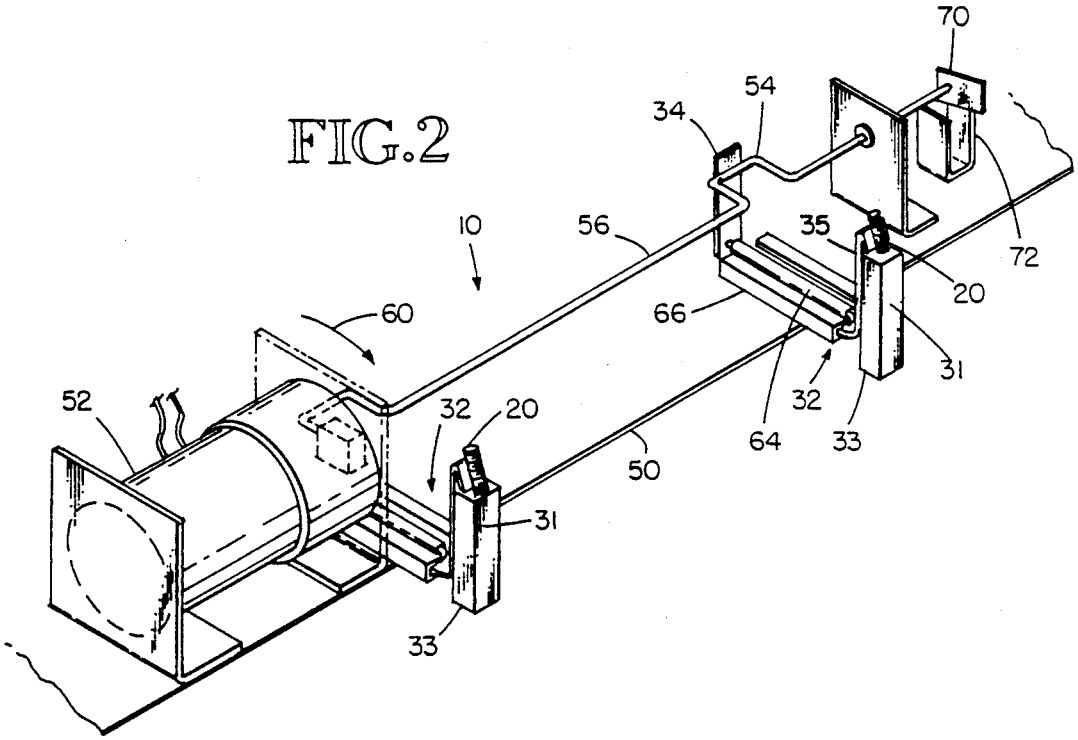
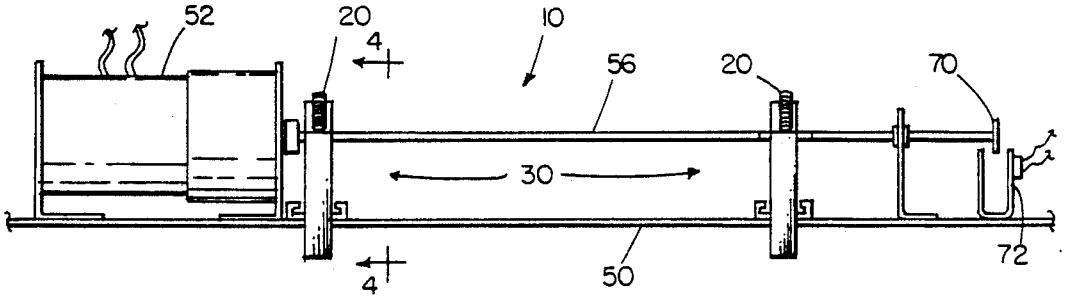
FIG.3

FIG. 7
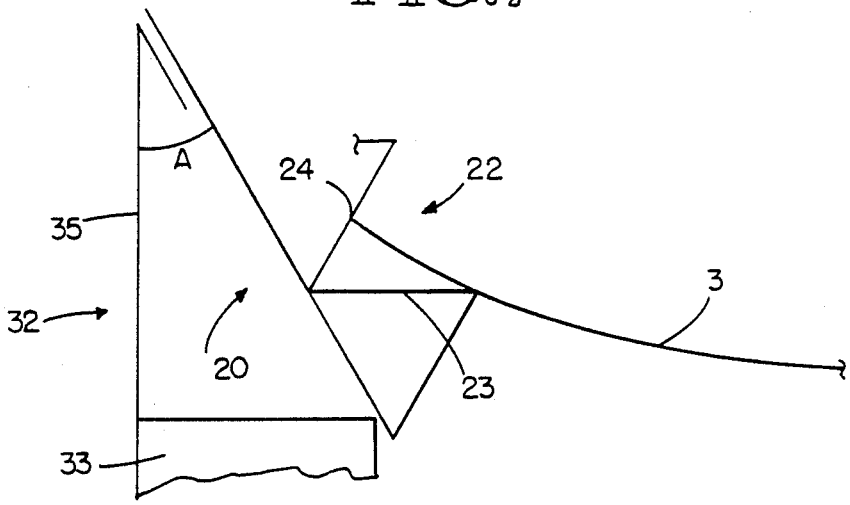
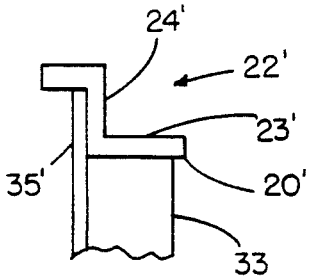
FIG. 8
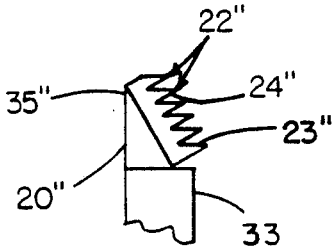
FIG. 9

EDGE ALIGNER/HOLDER DEVICE

TECHNICAL FIELD

The invention relates to the field of sheet sorting and stacking devices, and particularly to paper sheet sorters and stackers. More particularly, the invention pertains to an apparatus and method for piling individual sheets onto job stacks in an offset stacking device to obtain a sharply defined stack registration edge.

BACKGROUND OF THE INVENTION

In paper sheet handling, it is often necessary or desireable to make stacks or piles of sheets fed from some high speed duplicating or printing machine which have at least one stack registration edge surface as flat and sharply defined as possible. Furthermore, it is often desireable to separate the sheet output of a high speed duplicating or printing machine into off set job stacks, each job stack requiring its own well defined, and often highly defined, stack registration edge surfaces. A registration edge, in a horizontally piled stack of sheets, is a vertical surface of the side of the stack. Production of job stacks with highly defined registration edge surfaces is required where the job stack is to subsequently be bound without further stack preparation.

Some offset stackers, such as that disclosed in U.S. Pat. No. 4,817,934, make use of the force of gravity to urge successively piled sheets in a stack against a tote tray end stop to achieve stack registration end definition. Other offset stackers, such as disclosed in co-owned U.S. patent application Ser. No. 07/144,539, make use of a jogging device which jogs each successively received sheet of a stack of sheets against one or more vertically disposed stops to create a defined and substantially horizontal job stack. However, these offset stacking devices are not usually intended to produce the quality of defined stack edge that is sometimes required in certain paper handling applications, especially when asked to receive and create well defined stacks of sheets at high rates of sheet delivery to the stacker.

One of the difficulties with the above devices, and with other, conventional, stacking and offset stacking devices, results from a paper sheet's tendency to stick slightly to a sheet immediately below it in a stack. This is due, it is believed, partly to electronic charge accumulation in the sheets, and partly to frictive cohesion. Thus, jogging a top sheet will usually impart a moment of jogging momentum to one or more sheets immediately below the top sheet. This becomes particularly the case where a jogging mechanism applies necessarily greater force normal to the sheet in order to grip the sheet and pull it away from the sheet next below. This kind of "remedy" is thus somewhat self defeating. Another difficulty arises from the response of the sheet to its arrival upon the stack receiving surface and collision with the tote tray end stop. It tends to bounce back, to a degree largely dependent upon the sheet's beam strength and other factors as well, and to thereby form a misaligned stack registration edge as the sheets pile up.

Accordingly, there is a need for a device which can be used with a high speed offset stacking machine, and which accommodates the tendency of paper sheets to bounce back from their stops, and which furthermore positively aligns the trailing edge of each sheet with the stack registration edge surface after the sheet is received upon the stack. There is also a need for a device which reduces the tendency of a jogging mechanism to impart jogging momentum to sheets immediately below the sheet being jogged, and which provides a remedy to the tendency of paper sheets to stick slightly to one another during jogging, but without imparting jogging momentum to underlying sheets.

DISCLOSURE OF INVENTION

It is therefore an object of the invention to provide an apparatus and method for continually aligning a registration edge of a job stack as each successive sheet is delivered to the stack.

It is a further object of the invention to provide an apparatus and method for holding the trailing edge of each sheet newly delivered to the stack at a distance above the receiving surface of the stack so that the action of the offset stacker's jogging mechanism which is exerted upon each newly delivered sheet imparts a reduced amount of momentum, as compared to conventional stackers and joggers, to sheets immediately below the newly delivered sheet with its upraised trailing edge.

It is still another object of the invention to provide an apparatus and method which combines and achieves both of the above objects, even for high rates of sheet delivery to the offset stacker.

The invention comprises method and apparatus for continually aligning a registration edge of a job stack, while holding each next successively fed sheet at its trailing edge briefly, partially, and slightly above the receiving surface of the stack while the sheet is jogged. The apparatus and method of the invention may be used and practiced respectively in an offset stacker with any intermittent cycling, or cycle interuptable, jogging device such as the jogging mechanism described in co-owned U.S. patent application No. 07/144,539 now issued as U.S. Pat. No. 4,890,825. The high speed jogging of rapidly and successively fed sheets into sharply defined and registered job stacks may best be accomplished by a positive, firm, and brief jogging contact with each newly fed sheet. Preferably, the jogging contact does not disturb the sheets which have already been fed and registered, and methods and apparatus which allow jogging of the top sheet to occur with only the slightest of pressure from a jogging foot are preferred, so as not to disturb the underlying sheets.

The apparatus of the invention is an edge aligner/-holder which has at least one edge aligner reciprocal between forward and rear positions which in turn has a resilient front end and a tail piece. The tail piece is cooperatively interengaged by a conventional reciprocating mechanism. The apparatus also has at least one holder, each holder having at least one step, and each step having a backstop and a rest. The holder is disposed upon the edge aligner above the front end such that a portion of at least one of the rests extends forward of the stack registration edge when the edge aligner is in its forward position.

The method of the invention comprises the steps of (1) aligning the trailing edges of the sheets of an uppermost portion of a stack of sheets by urging a resilient pad against the uppermost portion of the stack in the direction of a tote tray end stop, while feeding the leading edge of a next sheet onto the stack; (2) holding the trailing edge of each next sheet a distance above the stack while this next sheet is then jogged to one side, and while the uppermost portion of the stack is held in alignment as above; (3) releasing the next sheet's trailing edge while withdrawing the pad from the uppermost stack portion so that this next sheet falls to the stack of sheets; (4) repeating steps 1–3 until a stack of the desired height is reached.

In a preferred embodiment of the invention incorporated into an offset stacking and jogging machine, the method of the invention comprises the steps of feeding a sheet onto a tote tray and sensing the delivery of the sheet to the tray, stopping the forward edge of the sheet against a tray end stop while at substantially the same time catching the trailing edge of the newly fed sheet on a sheet holder for holding the sheet partially above any other sheets in the tray; cycling the jogging device while the sheet is held with its trailing edge raised upon the sheet holder and while the trailing edges of any upper most sheets on the tray are held in registered alignment by an edge aligner; and then reciprocating the edge aligner rearwardly with its attached sheet holder to cause the held sheet to drop onto the surface of the stack and thereafter align it with the edge aligner as it completes its reciprocating cycle. In this way the jogger foot need work against only that amount of friction which exists between the top surface of any stack on the tray and the partially raised surface of the newly delivered sheet.

In other preferred embodiments the invention additionally comprises a set of paper dampers which are weighted and positioned, in one embodiment, at a point some half-inch rearward of the forward edge of the newly arrived sheet, to hold a sheet to the receiving surface with sufficient force to allow the newly fed sheet to slide beneath the damper and to assist in reducing bounce back.

In the embodiment of the invention described just above, the apparatus comprises at least one edge aligner/holder structure, in combination with a tray receiving system of any conventional design, or of a design such as that disclosed in co-owned U.S. patent application Ser. No. 07/144,539 now issued as U.S. Pat. No. 4,890,825, and a jogging mechanism as above described. A preferred embodiment of the jogging apparatus of this combination will allow a top sheet to be jogged in one of two directions, namely against a first or a second side wall and along a back wall. Where the distance between the respective side walls is greater than the dimension of the paper as measured transverse to the paper path, and if the passing direction of the jogging apparatus is reversed after each job stack or job set is completed, then the sheets may be jogged into clearly defined and offset uniform job stacks. Such a jogging apparatus may be employed with tote trays having side walls with variable positions at different locations on the tray assembly, thereby providing various distances between the first and second side walls, to accommodate offset stacking of differently sized sheets. Sheet delivery sensing means may be employed with the apparatus of the invention to trigger the operation of the jogging apparatus. Also a sheet delivery sensing means may be provided with a time delay means to allow each incoming sheet to become deposited upon the receiving surface of the tray assembly before the jogging apparatus is activated.

Where multiple tote tray systems are employed to receive and stack sheets, it is contemplated that it would be advantageous to have the individual tote trays of those tray systems remain relatively vertically stationary during stacking operations. Of course, each tote tray can be slidably mounted with the framework of the overall stacking apparatus so that it can be removed when full. Instead, it is contemplated that a sheet delivery path from the high speed printing or duplicating source terminates in an elevating mechanism within which rides the jogging apparatus of the invention. That is, it is the sheet path end, and the jogging mechanism, which move upwardly with respect to the floor of a tote tray as the job stack or stacks grow higher, and as each tote tray is loaded. This system would have the advantage that, where multiple tote trays are employed, the elevating mechanism of the jogging apparatus can readily be moved upwardly or downwardly to the proper position above the floor of the next available empty tote tray while the one which is full is being removed and off loaded. Where a single tote tray is employed, the tote tray can have an elevating mechanism such as that described in the co-owned and copending U.S. patent application Ser. No. 144,539 now issued as U.S. Pat. No. 4,890,825 entitled PaperSheet Stacking and Jogging apparatus, wherein various sensing means determine the present height of a job stack and the elevating mechanism appropriately lowers the tray floor so that relative height positioning of the receiving surface of the job stack remains approximately the same with respect to the jogging apparatus employed.

In a preferred embodiment the combined apparatus above employs a vertically movable carriage such as described above which comprises a sheet feeding roller system and the edge aligner/holder structures, and which carriage is controlled by means which sense the height of the job stack as it grows higher and accordingly incrementally raises the carriage above the job stack so that the edge aligner/holder stays at the top of the growing job stack. Also in a preferred embodiment there are logical controls to postpone the carriage's raising signal from actuating the carriage until the edge aligner/holder structures are in a withdrawn phase of their reciprocal cycle.

In an early embodiment of the invention the holder was one, or a series, of substantially horizontal ledges disposed above and rearwardly to the front end of the edge aligner. In a preferred embodiment a molded serrated surface is disposed at an angle from the vertical to catch and hold the trailing edge of sheets as they are delivered to discourage any bounce back of the sheets. In operational tests this preferred embodiment has been found to receive sheets at speeds up to 170 sheets/minute without jamming and with very tight and sharply defined registration.

Each edge aligner structure is preferably a cam operated, foam covered strut and tail piece disposed substantially vertically and parallel to the rearward registered surface of the job stack. The foam employed must be firm enough to hold the sheets in alignment while the jogging operation is occurring, but not so firm as to cause an impression in the sheets at their edges, or to induce a bounce of the edge/aligner apparatus as it engages the registration edge; and yet soft enough to grip the sheets, but not so soft as to allow them to move. In a preferred embodiment the foam has a relatively smooth and abrasion resistant surface, such as that provided by a strip of 3M brand (Minnesota Mining and Manufacturing Co.) packing tape, to keep the foam from being cut and to reduce drag on the stack. The preferred foam is a 3M brand foam, part number 4304, ⅛ inch thick by ¼ inch wide foam strip, approximately 2 inches long. Each edge aligner/holder structure is reciprocated by a motor driven cam from sheet sensing control circuitry and logic as described above.

It is contemplated that the edge aligner/holder apparatus may be employed to advantage in a dual tote tray system having both totes be adjustable for paper length. Each of these totes serve as a depository for the sheets where the sheets may be stacked and jogged into separated, highly defined job sets. The preferred tote assembly supports a large quantity of stacked sheets and is comprised of a floor, a back wall, and at least one side wall. These back and side walls then serve as sheet stops and as alignment means against which the sheets are jogged. The floor serves as the initial receiving surface or platform upon which the first of a series of sheets is stacked, with the upper most of the successively stacked sheets forming the next receiving surface upon which each next successive sheet is stacked. Individual sheets are received from a source, such as a high speed printing or duplicating device, and are then deposited upon this receiving surface of the tote assembly which is generally located beneath the jogging apparatus of the invention. The jogging apparatus may be used to jog sheets into job stacks either in the direction of the sheet delivery path as the sheets are delivered onto the tote assembly, or preferably in one of two directions transverse to the direction of sheet path delivery.

The adjustment of these totes for paper length is by means of adjustable tote side stops that have their surfaces preferably cork covered for light frictional enhancement. The widths of the tote side stops should be preferably in the range of 2 inches wide, as wider widths cause paper end creep, and widths not as wide cause bounce of the paper, impressions in the edge of the paper, and a tendency of the paper to conform itself around the narrower stop. It is contemplated that other embodiments of the side stops will have, rather than a cork covering, a series of horizontal striations or engravings.

In this contemplated application, the forward edge of each arriving sheet is stopped by an end stop, which in a preferred embodiment has a stop surface approximately 6 inches wide, on either side of which are disposed shoes which are recessed by 0.050 inches forwardly from the end stop surface. End stops which do not employ these flanking recessed shoes are subject to having the sheets "walk" up the sides of the end stop and result in poorly registered job stacks, and stops which have shoes recessed on either side as deeply as a quarter of an inch do not squarely enough stop the sheets.

Setting an optimum distance between the forward and rearward positions of the edge aligner/holders must take into consideration variances in width of sheets to be stacked, such that when the edge aligner/holder is reciprocated rearwardly, it is comfortably beyond the width of the largest possible sheet. Yet when the edge aligner/holder returns to its forward position, it is firmly against the registered surface of a stack of even the narrowest width sheets. Similar considerations dictate the placement of the serrated holder atop the aligner. That is, because the holder holds the newly delivered sheet in a slight curve or bow, a portion of the holder must actually be projecting across the rearward registered edge of the sheet stack and above the receiving surface lest the sheet simply fall to the surface. The holder is positioned upon the aligner to establish an optimum height of the held trailing edge of the sheet above the receiving surface of the stack. A height is preferably set which establishes approximately a 5–10 degree angle of the sheet-to the receiving surface of the stack (measured approximately tangently to the curved and held sheet).

To reduce rebound of the sheet after it strikes the end stop, the serrated holder, as it is positioned above the edge aligner, must be disposed so that the back stop of any holder step presents a stopping surface to the trailing edge of the sheet. Preferably holder step backstops do not approach the vertical. In preferred embodiments, where a 5-10 degree (tangent) angle of the curved held sheet to the horizontal is maintained, it has been found that setting a holder angle that results in the trailing edge of the sheet meeting the backstops substantially perpendicularly effects the surest rebound stops. In this configuration, the already curved sheet does not tend to "ride up" the backstop Steeper holder angles also prevent "ride up," but allow some rebound as the sheet rides down in the step. For example, with serrated holders, which have 60 degree points, a preferred disposition of the holder of just greater than 30 degrees from the vertical creates rests which are raised slightly from the horizontal, and backstops which are approximately 30 degrees from the vertical and leaning toward the trailing edge of the sheet. With the tangent of the sheet at 5–10 degrees to the receiving surface of the stack, the natural curve of all but the heavier weight sheets will cause the trailing edge of the sheet to impinge the backstop at close to a 90 degree (tangent) angle. Angles of the holder with respect to the vertical however may be varied to greater than 30 degrees so long as the backstop preferably does not become vertical itself.

BRIEF DESCRIPTION OF THE DRAWINGS

FIG. 2 is an isometric view of a preferred embodiment of the invention.

FIG. 3 is a front elevational view of the embodiment shown in FIG. 2.

FIG. 7 is a schematic detail illustration of a portion of the apparatus of FIG. 1.

FIG. 8 is a partial elevation of an alternate embodiment of the holder portion of the invention.

FIG. 9 is a partial elevation of an other alternate embodiment of the holder portion of the invention.

BEST MODE FOR CARRYING OUT THE INVENTION

Figure 1:
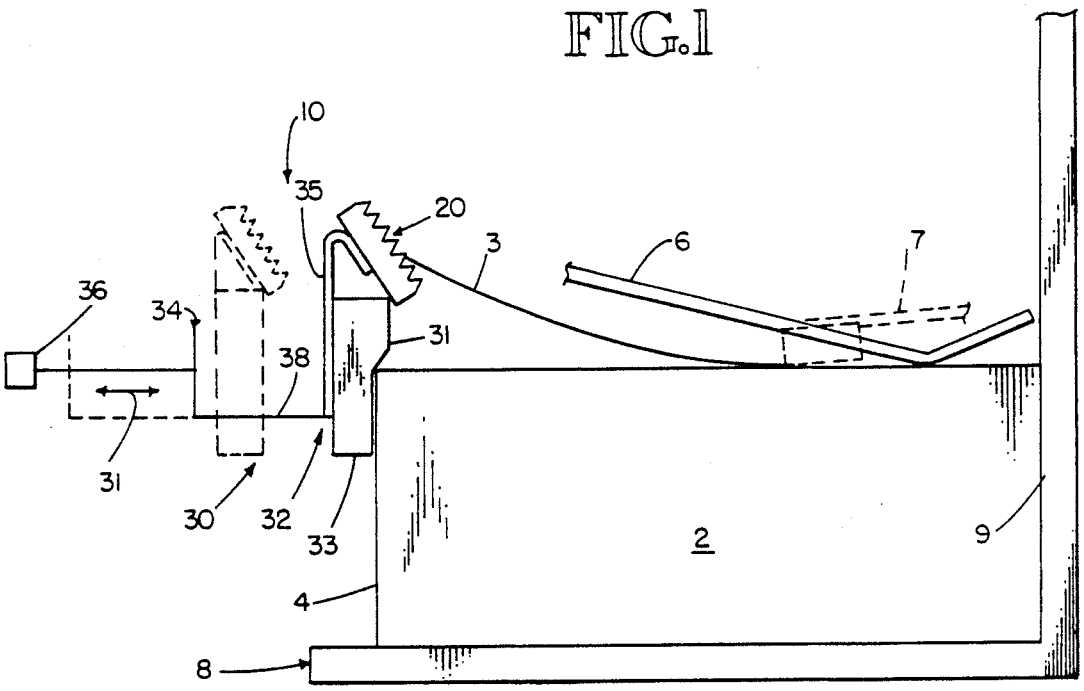
FIG. 1 is a side elevation of the apparatus of the invention in a typical application, with the edge aligner/holder mechanism shown in its retracted position by broken lines, and with reciprocating mechanism schematically illustrated.

Referring now to the drawings wherein like numbers indicate like parts the invention is described with reference to specific and preferred embodiments to illustrate the best mode contemplated for carrying out the invention. A general scheme of the apparatus of the invention is first described in FIG. 1. On a tote tray 8 slidably engaged within the support frame of an offset stacking machine (not shown), a job stack 2 consisting of a plurality of sheets has been deposited. The sheets of job stack 2 have been urged against end stop 9 to form rearward stack registration edge 4. In a typical application, and mounted within a support structure which (not shown) is in turn connected to the support frame of the same offset stacker, a jogging mechanism, the jogging foot 7 of which is schematically and partially represented in FIG. 1 by broken lines, and damper 6. Mounted within the same carriage is edge aligner/-holder 10. It is contemplated that either of two arrangements will serve to effect a necessary height adjustment of edge aligner/holder 10 and its supporting carriage with respect to the surface of stack 2 as stack 2 grows in height with the addition of next sheet 3. Either tote tray 8 may be moved downwardly as the height of stack 2 grows, or the carriage upon which edge aligner/holder 10 is mounted may move upwardly. In a preferred application edge aligner/holder 10, damper 6, and jogging mechanism 7 are all mounted within a carriage (not shown) which moves upwardly incrementally as the height of stack 2 grows. Such an apparatus would contain sensors and control logic to sense the height of stack 2 and to direct the energizing of appropriate driving motors to raise the height of the carriage.

Edge aligner/holder 10 has an edge aligner 30 mounted for reciprocal movement upon a portion of the support frame 50 of the carriage (see FIGS. 4–6 for details, described below). Edge aligner 30 has a front end 32 and a tail piece 34 connected by a cross piece 38. This arrangement is shown only in schematic side elevation in FIG. 1 for ease of illustration. Tail piece 34 is cooperatively interengaged with a reciprocating mechanism 36 also schematically illustrated in FIG. 1. Reciprocating mechanism 36 is energized according to control logic within the offset stacker to reciprocate edge aligner 30 between a forward position and a rearward position in the reciprocal directions shown by arrow 37. FIG. 1 illustrates edge aligner 30 in its forward position, with the rearward position illustrated by broken lines. It will be appreciated by those skilled in the art that a variety of reciprocating mechanisms will serve as reciprocating mechanism 36. For instance reciprocating mechanism 36 may be a simple electrical solenoid. It may also be a rotating cam connected through suitable linkage to tail piece 34 such that tail piece 34 is thrust or pulled rearwardly when the lobe of the cam points rearwardly. A preferred embodiment for reciprocating mechanism 36 is illustrated in more detail in FIGS. 2–6 and further described below.

Front end 32 has, in preferred embodiments, a front strut 35 projecting substantially normally from cross piece 38. In preferred embodiments, front strut 35 is therefore substantially vertical and therefore substantially parallel with registration edge 4 of stack 2. However, as will be appreciated by those skilled in the art, and as further discussed below, an exact parallel alignment between front strut 35 and registration edge 4 is neither necessary nor required because of the advantages of the invention; it is simply easier to design and maintain the edge aligner/holder structure 10 if front strut 35 is substantially vertical, with cross piece 38 typically running horizontally. Front end 32 also comprises a resilient pad 33 which preferably has on its forward surface an abrasion resistant facing 31. In preferred embodiments resilient pad 33 is a compressible foam rubber pad made from some foam rubber which may be readily compressed but which resiliently springs back to its original shape as the compressive forces are lessened or removed. Abrasion resistant facing 31 can be as simple as a strip of smooth faced clear packing tape, though other abrasion resistant facing suitable for mounting on various types of resilient pad, or various types of foam rubber, will occur to those skilled in the art without departing from the scope of the invention. Similarly, many different materials will occur to those skilled in the art as suitable for resilient pad 33 other than the many different kinds of foam rubber possible. Resilient pad 33 may be integral with front end 32 and-/or front strut 35, or may be, as in a preferred embodiment, attached thereto.

As edge aligner 30 is reciprocated into its forward position resilient pad 33 is thrust against registration edge 4 along an upper most portion of stack 2. This has the effect of continually aligning and realigning the upper most sheets of stack 2 against end stock 9 each time edge aligner/holder 10 is reciprocated to its forward position. Where, as in preferred embodiments, a soft type of foam rubber is employed as resilient pad 33 the force exerted on the trailing edges of the sheets in the upper most portion of stack 2 is very slight, and sufficient only to provide a small urging of the sheets into, or back into, alignment with registration edge 4. A portion of resilient pad 33 is set to project above the top surface of stack 2 in preferred embodiments to accommodate the growth and height of stack 2 until a change in height between edge aligner/holder 10 and tote tray 8 is effected. Some overlap of pad 33 above the top edge of stack 2 also insures that as stack 2 grows in height no sheets in the upper portion of stack 2 are left unurged continually toward end stop 9. Abrasion resistant facing 31 serves to cut down on the wear, particularly wear from the cutting effect of the sharp trailing edges of the sheet in stack 2, on resilient pad 33 so that replacements for pad 33 are not required as often, as when no abrasion resistant facing 31 is employed.

It is contemplated that some resilient pad materials, by their nature, will have on their front surfaces and integral therewith the equivalent of an abrasion resistant facing. Abrasion resistant facing 31 also assists in preventing the material of resilient pad 33 from sticking, however slightly, to one or more of the trailing edges of the sheets of stack 2 as edge aligner 30 is reciprocated to its rearward position and as edge aligner/holder 10 is moved vertically to accommodate the change in the height of stack 2. It is contemplated that further control logic and sensors will be employed to detect when edge aligner 30 is in its forward position to temporarily defeat what might otherwise be a control signal to change the height of edge aligner/holder 10 until edge aligner 30 has been withdrawn to its rearward position. One example of this type of sensor is shown in FIGS. 2 and 3 and further described below. This kind of mechanism will serve to prevent what could otherwise result in a jarring of the uppermost sheets of stack 2 out of registration if edge aligner/holder 10 were raised while resilient pad 33 were still in compressed contact with registration edge 4.

Disposed atop front end 32 at an angle rearward from the vertical is edge holder 20. In preferred embodiments edge holder 20 is mounted upon a suitably projecting portion of front strut 35. However, other methods and means of mounting an edge holder 20 atop front end 32 will occur to those skilled in the art without departing from the scope of the invention. For instance a resilient pad 33 is contemplated projecting far enough up from cross piece 38 and having sufficiently rigid structural properties that it could be shaped to have an edge holder 20 mounted thereon without the use of a front strut 35, or without any portion projecting therefrom. In a preferred embodiment, edge holder 20 is a simple molded plastic bar having serrations on its front angled edge. These serrations may take any of a number of shapes (also see FIG. 9).

The serrations generally consist of a series of teeth which form in the spaces between the teeth holder steps 22 (FIG. 7), each step having a rest 23 and a backstop 24. In a preferred embodiment, the teeth of edge holder 20 are regular and pitched at approximately 60 degrees. This arrangement has been found to provide best service, especially in connection with other considerations discussed further below. However, the teeth of edge holder 20 do not need to be regular, nor do the teeth need to be pitched at or near 60 degrees. For instance, in FIG. 9 an edge holder 20'' is illustrated having a "saw tooth" arrangement of teeth. Edge holder 20'' has a series of steps 22'' each having rest 23'' and backstop 24'' to function in the same way as that described for the edge holder 20'' depicted in FIG. 1. A detail of two of the teeth of edge holder 20 in FIG. 1 is shown in FIG. 7 in schematic layout for ease of illustration.

Other materials for edge holder 20 may be employed without departing from the scope of the invention including a simple ledge type arrangement schematically illustrated in FIG. 8 where edge holder 20'' has a single step, or a series of steps 22'' each having a rest 23'' and a backstop 24''. One very successful embodiment, illustrated in FIGS. 2–6, employs a simple length of common threaded nylon rod.

Edge holder 20 is mounted upon a front end 32 of edge aligner 30 in such a way as to establish a preferred two dimensional relationship. Firstly, a newly arrived next sheet 3 fed onto stack 2 should have the fall of its trailing edge interrupted by edge holder 20, which requires that at least a portion of one of the rests 23 of edge holder 20 must project sufficiently forward of registration edge 4 that the trailing edge of sheet 3 may not fall all the way to the receiving top surface of stack 2. Since sheet 3, after arriving upon stack 2 and having its forward edge abut end stop 9, will assume a curve, a line tangent to which will be at an angle to the receiving surface of stack 2, the trailing edge of sheet 3 will not be coincident with registration edge 4 but will be somewhat forward of registration edge 4. It will be appreciated that the angle of the tangent to the curve of sheet 3 will depend upon the height placement of edge holder 20 with respect to front end 32, and that the amount of forward projection required of edge holder 20 will depend upon that angle, which in preferred embodiments will lie between 5 and 10 degrees from the horizontal. Thus, the height of edge holder 20 is set so that, regardless of the width of paper being stacked, a preferred embodiment of the invention will hold each new sheet 33 at an angle somewhere between 5 and 10 degrees (measured tangentially) from the horizontal receiving surface of stack 2. It is then required only that a portion of one of the rests 23 of edge holder 20 project far enough forward of registration edge 4 to catch the trailing edge of the narrowest width of sheet 3 to be stacked.

In operation at the start of any given cycle of reciprocal motion of edge aligner 30, and before a particular next sheet 3 has been fed, edge aligner 30 is reciprocated to its forward position as sheet 3 is fed and detected descending to stack 2. This realigns the upper most sheets of stack 2 with end stop 9 to reregister the trailing edge of the sheets with registration edge 4 and holds the upper most sheets of stack 2 in alignment as sheet 3 descends. In preferred embodiments however, the normal "rest" position of edge aligner 30 is the rearward position. Thus as a sheet 3 is fed through a sheet roller mechanism (not shown) its presence is detected and the reciprocating mechanism 36 is activated to reciprocate edge aligner 30 into its forward position. The forward momentum of sheet 3 carries it beneath weighted damper 36, which in preferred embodiments take the form of one or more conventional wire paper bails so that the forward edge of sheet 3 runs into contact with end stop 9 and is thereby arrested in its forward motion. The preferred action of damper 6 is to allow the forward motion of sheet 3 to contact with end stop 9 with little resistance thereto, but to give some small resistance to the backward bounce of sheet 3 as it strikes end stop 9. The trailing edge of sheet 3 then falls to settle upon edge holder 20 and the slight residual back bounce of sheet 3 caused by collision with end stop 9 serves to seat the trailing edge of sheet 3 into step 22 of holder 20 and against backstop 24 (see detail in FIG. 7). The jogging foot 7 (not otherwise shown) is then cycled into contact at the portion of sheet 3 which lies relatively flat upon the receiving surface of stack 2 so that sheet 3 is jogged to one side or the other (that is, in FIG. 1, normally into, or out of, the page). It has been found that only a very light touch of jogging foot 7 is required to move sheet 3 sideways because the trailing edge of it is held partially up by holder 20. Consequently, little or no jogging momentum is conveyed through sheet 3 to the top most sheets of stack 2 and very tight registration is maintained, especially since edge aligner 30 in its forward position is exerting a force to hold those sheets in alignment while the jogging action is occurring. Continuing a description of the typical operation of the invention, as the jogging foot 7 completes its cycle and is raised from contact with sheet 3, the completion of the cycle is sensed and control logic activates reciprocal mechanism 36 to withdraw edge aligner 30 to its rearward position, thus releasing the trailing edge of sheet 3 and removing the aligning force of edge aligner 30 from the trailing edges of the top most sheets of stack 2. This completes one sheet cycle of both the edge aligner/-holder 10 and the jogging mechanism to create a tightly registered stack 2. Additional next sheets 3 each have their own cycle.

Referring now to both FIGS. 1 and 7, it can be seen that the curve assumed by sheet 3 as its trailing edge rests upon rest 23 of holder 20 causes the trailing edge of sheet 3 to point upwardly at an angle greater than the 5–10 degree average tangent of the curve of sheet 3. That is, while the average tangent to the curve of sheet 3 will normally be at an angle of 5–10 degrees, the curve of sheet 3 is most extreme at its trailing edge, especially when the full weight of the suspended portion of sheet 3 is on rest 23. The arrangement of holder 20 and the angle "A" (FIG. 7), which is the angle of the plane of the points of the teeth of holder 20 to the vertical, is set so that the angle of the surface of backstop 24 is preferably at the optimum angle for catching the trailing edge of sheet 3 as it rebounds into step 22.

It may be seen from FIG. 7, and will be appreciated by those skilled in the art, that the angle of backstop 24 from the vertical should preferably be such that the trailing edge of sheet 3 is substantially normal to the surface of backstop 24. This provides the cleanest stopping action. Greater angles will tend to force the trailing edge of sheet 3 further into step 22 as the trailing edge of sheet 3 is urged to slide down backstop 24. On the other hand, and more importantly, as the angle of the backstop approaches the vertical, the tendency of the trailing edge of sheet 3 to ride up the backstop increasing until the point is reached where the trailing edge of sheet 3, given sufficient rebound force, will ride up and over the top of backstop 24 and enter the next step.

While this is not fatal to the successful working of the invention, it is to be preferably avoided so that, as the trailing edge of sheet 3 falls to the receiving surface of stack 2, as little movement as possible of edge aligner 30 and resilient pad 33 is required to bring sheet 3 atop stack 2 into alignment with registration edge 4.

Where two or more edge aligner/holders 10 are employed in an apparatus, the contact of the trailing edge of sheet 3 with each of the backstops 24 of the holders 20 also serves beneficially to prevent any tendency of sheet 3 to rotate under the influence of the jogging motion imparted by jogger foot 7. It is here as well, and perhaps more critically, that the need for retaining the trailing edge of sheet 3 within a step (that is, not letting it ride up over the top of backstop 24) can be most appreciated. If the trailing edge of sheet 3 rides out of one step 22 for one holder, but not for the other, the sheet 3 will have effectively rotated slightly, and require more alignment force to bring it back into registration with registration edge 4.

In a preferred embodiment having regularly spaced teeth, each tooth pitched at 60 degrees, the preferred angle "A" is something just less than 30 degrees. The purpose of having in holder 20 a series of regularly spaced teeth forming a plurality of steps 22 is so that the edge aligner/holder 10 can accommodate paper in a variety of weights and thicknesses without requiring adjustment. It will be appreciated by those skilled in the art that differing paper weights will have differing beam strengths, which in turn will result in sheet 3 having differing curvatures which will vary with the weight of the paper. Differing curvatures of sheet 3 will often result in the trailing edge of sheet 3 naturally finding a different step within which to fall and rest Different weights of paper will also have different rebound characteristics. Where many small regularly spaced steps 22 are provided, it is possible to stack a variety of weights of paper and yet provide a holder 20 which effectively minimizes rebound of sheet 3 after its collision with end stop 9 so that edge aligner 30 can more readily even up the trailing edge of sheet 3 and produce a superiorly registered stack.

With respect to the selection of a resilient foam material for pad 33, experimentation and testing make it clear that the resiliency and compressibility of the selected foam material is critical The foam must compress the correct amount under the influence of whatever force is provided by reciprocating mechanism 36 to urge pad 33 into contact with registration edge 4. Furthermore the selected foam must have an optimal compression even when the forward thrust of edge aligner 30 varies because of differing widths of paper stacks. That is, the compressibility of the foam over a range of forward thrust must lie within certain critical limits, the exact mathematical parameters of which have not yet been worked out. The concerns and criteria which go into the selection of this foam have also been discussed above, and at present it has only been experimentally determined that a certain 3M foam material works very well, but that many others do not work as well. The foam selected is a 3M brand foam product available under product number 4304.

In order to achieve optimal compressibility and resilience over the expected range of variation and paper width, pad 33 is selected to be made of the above foam material with a thickness of $\frac{3}{8}$ of an inch. The width of the pad, as seen from the front of the pad, is not believed to be as critical, but a quarter inch width has been effective where two pads on two edge aligners are employed as is illustrated in FIGS. 2–6. One other benefit of this particular foam, and of other foams which would meet the above discussed criteria, is that the foam will tolerate by its nature a slight misalignment of edge aligner 30 and particularly of front strut 35 with respect to the vertical and with respect to being nonparallel to registration edge 4.

Figure 4:
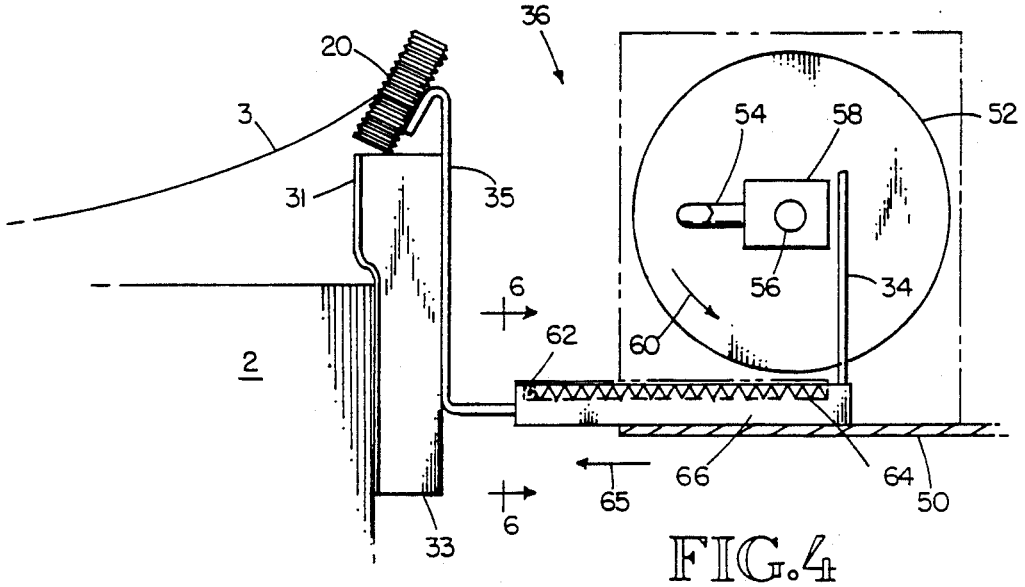
FIG. 4 is a partial side sectional view of the apparatus taken along lines 4—4 of FIG. 3, and including a schematic representation of a sheet and job stack.
Figure 5:
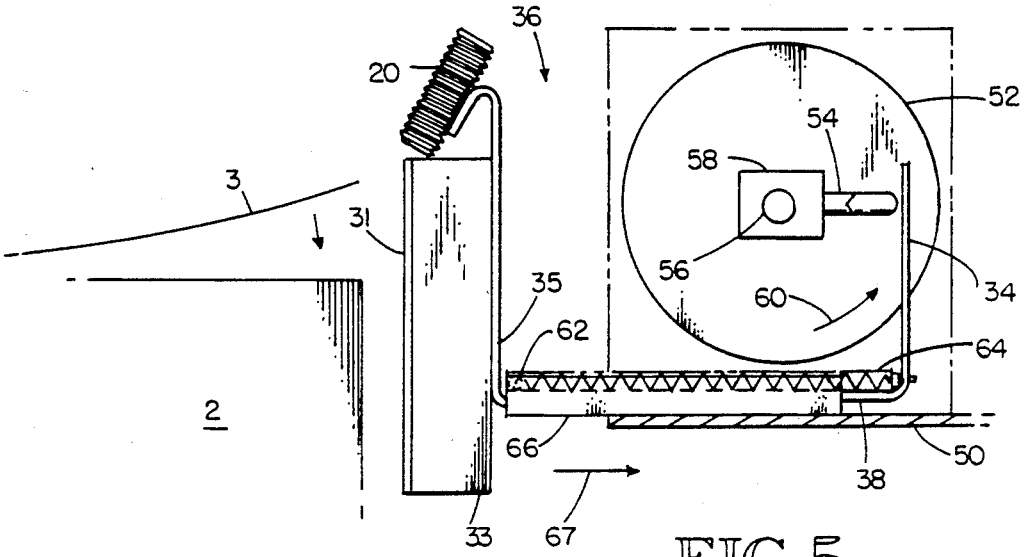
FIG. 5 is the same sectional view as shown in FIG. 4 but with the apparatus cycled to a different position.
Figure 6:
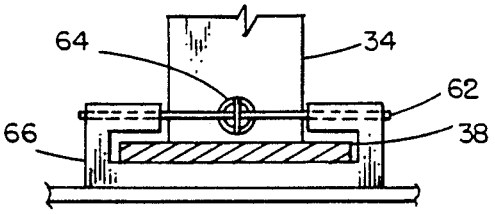
FIG. 6 is a partial sectional view taken along lines 6—6 in FIG. 4.

Referring now to FIGS. 2–6 a preferred reciprocating mechanism 36 is illustrated together with a preferred disposition of edge aligners 30 within an edge aligner/holder apparatus 10. Also in FIGS. 4 and 5 a detail of the reciprocal operation of edge aligner 30 is illustrated as it first holds aloft the trailing edge of sheet 3 (FIG. 4) in its forward position and then releases the trailing edge of sheet 3 (FIG. 5) as it is reciprocated to its rearward position. In FIGS. 2 and 3 an intermittently operatable electric motor 52 is mounted upon a support frame 50 and is controlled through control logic so that motor 52 causes rotation of crank shaft 56 only when energized to do so. Motor 52 is connected to crank shaft 56 by connector 58 (FIGS. 4, 5). Crank shaft 56 has two cranks 54. Shaft 56 and cranks 54 are formed from conventional wire and bent by conventional means into the configuration shown. However, other shaft and crank materials and means of forming may be employed without departing from the scope of the invention. In particular, cranks 54 may be replaced by single lobe cams.

Spaced apart and also mounted on support frame 50 are a pair of edge aligners 30 (FIG. 3). Edge aligners 30 have front end 32 and tail piece 34 and cross piece 38 (FIG. 5) connecting them. Cranks 54 serve to displace tail pieces 34 rearwardly at a point in the cycling of motor 52 and shaft 56. In this embodiment, edge aligners 30 also each comprise a guide 66 which is attached to support frame 50 and within which is a slidably mounted cross piece 38. At the forward end of guide 66 a retaining pin 62 retains one end of a spring 64. The other end of spring 64 is retained through a hole in a lower portion of tail piece 34 (FIGS. 4 and 5). Thus crank 54 urges tail piece 34 rearwardly at a segment of the rotational movement of shaft 56 against the spring tension of spring 64. Therefore as crank 54 rotates away from its maximum rearward urging of tail piece 34, edge aligner 30 is returned under spring tension to follow crank 50 and to move forwardly to its forward position (FIG. 4) so that pad 33 is compressed against registration edge 4 under the tension of the spring 64.

The spring tension is critical for reasons as discussed above in connection with the selection of the particular type and size of the piece of foam for pad 33. Too much spring tension will cause pad 33 to urge against registration edge 4 with too great of force with the results above described. Too little spring tension will not compress pad 33 sufficiently to align and hold the sheets in the upper most portion of stack 2. A Century Spring #N-175 has been found to function well over a range of possible paper widths. These springs are available from the Century Spring Company in Los Angeles, Calif., and they are extension-type springs, ½ inch long at rest, composed of 0.007 inch music wire with 42 coils, and 0.109 inch outside diameter.

In FIGS. 4 and 5 side sectional views of reciprocating mechanism 36 are illustrated, showing direction of rotation 60 of crank shaft 56 and forward direction of reciprocation 65 (FIG. 4) and rearward direction of reciprocation 67 (FIG. 5). In FIGS. 2 and 3 there is schematically illustrated a sensor 72 which functions cooperatively with blade 70. Blade 70 is attached for rotation to crank shaft 56 such that it passes between the leaves of sensor 72 at only one point in the rotational cycle of shaft 56. Sensor 72 is a conventional type of light path interruption detector and sends a signal to the control logic of the offset stacker mechanism to hold off raising the carriage while the edge aligners 30 are in their forward positions.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

INDUSTRIAL APPLICABILITY

The invention will find use primarily in the paper sheet handling industry, and particularly in devices and machinery for creating offset job stacks. The invention represents an improvement in the speed of such offset stacking and the quality of the job stacks particularly with reference to the aligned job stack edges. Paper sheets can be fed to an offset stacking and jogging mechanism at a much higher rate than was previously possible while maintaining superior job stack alignment. The device is mechanically simple and adaptable for use with a variety of known or soon to be developed offset stackers.

We claim:

1. An edge aligner/holder for receiving sheets in a sheet stacking device for creating a job stack having a rearward stack registration edge, the apparatus comprising:

a) at least one edge aligner reciprocating between a forward position and a rearward position in a cycle for each received sheet, said edge aligner having a compressible and resilient front end and a tail piece, said tail piece cooperatively interengaged by a reciprocating mechanism for reciprocating said edge aligner; and b) at least one holder, each holder having at least one step, each step having a backstop and a rest, said holder disposed upon said edge aligner above said front end such that a portion of at least one of said rests lies forward of said stack edge when said edge aligner is reciprocated to said forward position.

2. The apparatus of claim 1 whereby each of a successive plurality of single sheets is sequentially:

1) held at an angular displacement from a receiving surface of a stack of sheets by said holder; and then 2) released to fall upon said receiving surface to thereafter become a new receiving surface for succeeding sheets;

whereby, contemporaneously and corresponding with the above two steps, the sheets of an uppermost portion of said job stack are alternately (1) urged forwardly against an end stop of a tote tray by said edge aligner, and (2) released to receive said single sheet as it falls.

3. The apparatus of claim 1 wherein said edge aligner/holder is reciprocated between (1) a forward position, and (2) a rearward position by said reciprocating mechanism.

4. The apparatus of claim 1 wherein said holder is a length of serrated material angled rearwardly from the vertical.

5. The apparatus of claim 4 wherein said serrated material is comprised of threaded rod.

6. The apparatus of claim 4 wherein said serrated material is comprise of a bar having on an upper edge thereof a plurality of uniformly pitched teeth.

7. The apparatus of claim 1 wherein each of the rests of said steps is a substantially horizontal ledge and wherein each of the backstops of said steps is a substantially vertical riser.

8. The apparatus of claim 1 wherein said front end further comprises a layer of resilient foam material disposed to face the registration edge of said job stack.

9. The apparatus of claim 8 further comprising a relatively abrasion resistant facing on that surface of said foam material which faces said job stack.

10. The apparatus of claim 9 wherein said abrasion resistant facing is comprised of a length of clear tape.

11. The apparatus of claim 1 in combination with a vertically movable carriage in which said apparatus is mounted, said carriage controlled such that as said stack grows in height, said carriage is moved upwardly.

12. The apparatus of claim 11 further comprising a paper bail and weighted damper hingably mounted upon said carriage, a portion of said paper bail resting upon a forward portion of the surface of said stack.

13. The apparatus of claim 11 in combination with a jogger mechanism mounted in said carriage for controlled intermittent contact with a top sheet of said job stack.

14. The apparatus of claim 1 wherein the number of said edge aligners and said holders respectively is two.

15. A method of sheet stacking for use in sheet stacking and jogging devices, the method comprising the steps of:

1) aligning the trailing edges of the sheets of an upper most portion of a stack of said sheets by urging a resilient pad there against in the direction of a tote tray end stop, while feeding the leading edge of a next sheet onto said stack;

2) holding the trailing edge of said next sheet a distance above said stack while said next sheet is jogged to one side and while said upper most portion of said stack is held in alignment as in step 1;

3) releasing said next sheet's trailing edge while withdrawing said pad back from said upper most stack portion, so that said next sheet falls to said stack of sheets;

4) repeating steps 1–3.

* * * * *